United States Patent [19]

Haneda et al.

[11] Patent Number: 4,477,174

[45] Date of Patent: Oct. 16, 1984

[54] DEVELOPING DEVICE

[75] Inventors: Satoshi Haneda; Makoto Tomono; Masahiko Itaya, all of Hachioji, Japan

[73] Assignee: Konishiroku Photo Industry Co., Ltd., Tokyo, Japan

[21] Appl. No.: 396,104

[22] Filed: Jul. 7, 1982

[30] Foreign Application Priority Data

Jul. 27, 1981 [JP] Japan ..... 56-116353

[51] Int. Cl.[3] ..... G03G 15/08

[52] U.S. Cl. ..... 355/3 DD; 355/14 D; 355/15; 118/652; 430/125

[58] Field of Search ..... 355/15, 3 DD, 14 D; 118/652, 653, 657, 658; 430/120, 125

[56] References Cited

U.S. PATENT DOCUMENTS

| | | | |
|---|---|---|---|
| 3,893,416 | 7/1975 | Eichorn | 118/652 |
| 4,265,197 | 5/1981 | Toyono et al. | 430/125 X |
| 4,320,958 | 3/1982 | Fantuzzo | 355/15 X |
| 4,339,196 | 7/1982 | Beck et al. | 355/3 DD |

*Primary Examiner*—A. C. Prescott

*Attorney, Agent, or Firm*—Frishauf, Holtz, Goodman & Woodward

[57] ABSTRACT

A two-cycle electrophotographic copying apparatus includes a rotatable charge retaining member, a charging device, an exposure mechanism, a developing device and a transferring device sequentially arranged around the charge retaining member in the direction of its rotation. During a first rotation of the charge retaining member, a toner image of an original is formed, and during the second rotation of the charge retaining member, the remaining toner is cleaned from the charge retaining member to prepare it for its next succeeding copying operation. The developing device comprises a first sleeve-like member for developing an electrostatic latent image on the surface of the charge retaining member during the first revolution thereof, and a second sleeve-like member for cleaning remaining toner from the surface of the charge retaining member during the second rotation of the charge retaining member and for suppying the removed developer to the first sleeve-like member during the first rotation of the charge retaining member. The second sleeve-like member is movable between first and second positions which correspond respectively to the first and second rotations of the charge retaining member.

28 Claims, 4 Drawing Figures

DEVELOPING DEVICE

BACKGROUND OF THE INVENTION

1. Field of the Invention

The present invention relates to a developing device for developing an electrostatic latent image formed on a charge retaining member in an electrophotographic process, electrostatic printing process, electrostatic recording process and the like.

2. Description of the Prior Art

An electrophotographic copying machine in which an electrophotographic process is utilized is partially schematically illustrated in FIG. 1. In this example, a freely revolvable electrophotosensitive receptor 1 is uniformly charged at first by a charging device 2 as said receptor 1 is revolved, and thereafter an image exposure is carried out by an exposure mechanism 3 to form an electrostatic latent image. Said latent image is developed by a developing device 4 to form a toner image, and the formed toner image is transferred by means of a transfer electrode 5 onto a transfer paper which has been synchronously conveyed on transfer paper passage P to match said toner image, and then the transfer paper is separated from the receptor 1. After the transfer paper is separated therefrom, the receptor 1 is still further revolved to carry out a whole surface exposure to light with an exposing device 6, or the electrostatic charge on the receptor 1 is eliminated by the means of a charge eliminating electrode 7 and then the toner still adhering onto the receptor 1 is removed by a cleaning device 8. The transfer paper onto which the toner image was carried is fixed and then ejected from the copying machine.

In the dry type developing methods for visualizing an electrostatic image in an image-forming process as described above, developer including colored powder (e.g., toner) is used. As to the developer, there have been known a two-component developer comprising a carrier and toner, and a one-component developer consisting of toner, and inter alia, the developing method using the one-component developer is capable of carrying out stable development because the toner density thereof does not relatively change in comparison with those of the methods using the two-component developer, and is advantageous in the simplification of the devices to be used.

Meanwhile, it is required that the toner in the developer should be charged at an opposite polarity to that of an electrostatic latent image on a charge retaining member when said toner is applied to a developing process. In the two-component development system, it is relatively easy to obtain the toner in a satisfactorily charged state because the toner is stirred together with the carrier. However, in the one-component development system, it is very difficult to control the charged polarity and charged volume because there exists no carrier like in the two-component developer, so that it has been a problem awaiting solution in the one-component developer to carry out an excellent development without fail.

Heretofore, as for the improvements on the developing devices using one-component developer, there has been proposed a developing device in which both a first sleeve for supplying a one-component developer onto the charge retaining member for development and a second sleeve for supplying a certain amount of charged one-component developer onto said first sleeve are used so that the charge control of the developer can easily be performed to supply regularly in the developing process or the developing device similar thereto.

On the other hand, as for a cleaning device for removing a residual toner from the charge retaining member, there have been known a blade type, fur brush type and magnetic brush type cleaning device, and the like, and inter alia the magnetic brush type cleaning device which also serves as a developing brush has popularly been known. There is a possibility that one device may commonly serve as a developing and a cleaning device to lower the cost thereof. In such a copying process, the steps of charging, exposing to light, developing, transferring and separating are carried out during the first revolution of the charge retaining member and then a cleaning step is carried out during the second revolution thereof.

In such a combination use, however, it is difficult to satisfy both the development function and the cleaning function, and particularly in the case that the developer to be used is a one-component developer, a development should be carried out so as to be in the state where the developer is brought into soft contact with the charge retaining member in the development area, or so as to work in a non-contact state. The requirement as stated above is also one of the factors causing the difficulties of the combination use stated above.

SUMMARY OF THE INVENTION

It is an object of the present invention to provide a developing device in which the same member is used to transport developer (hereinafter referred to as toner) to be supplied into the development area and to clean up said charge retaining member utilizing the developer carrying or transporting capability, so that each of the operations may be performed satisfactorily, without fail.

DETAILED DESCRIPTION OF THE PREFERRED EMBODIMENTS

Figure 1:
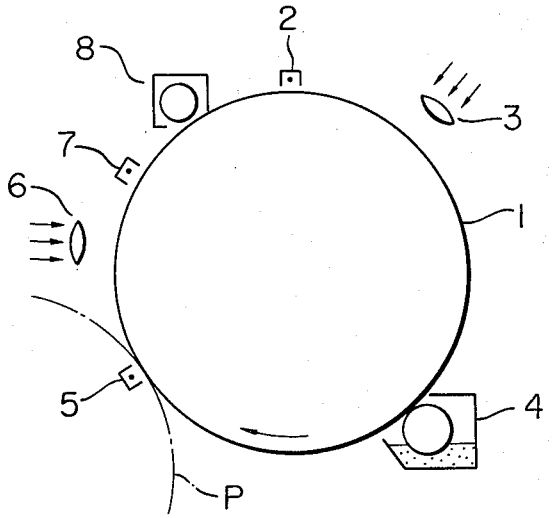
FIG. 1 (PRIOR ART)
FIG. 1 is an illustrative view of a known image forming device in an electrophotographic copying machine.
Figure 2:
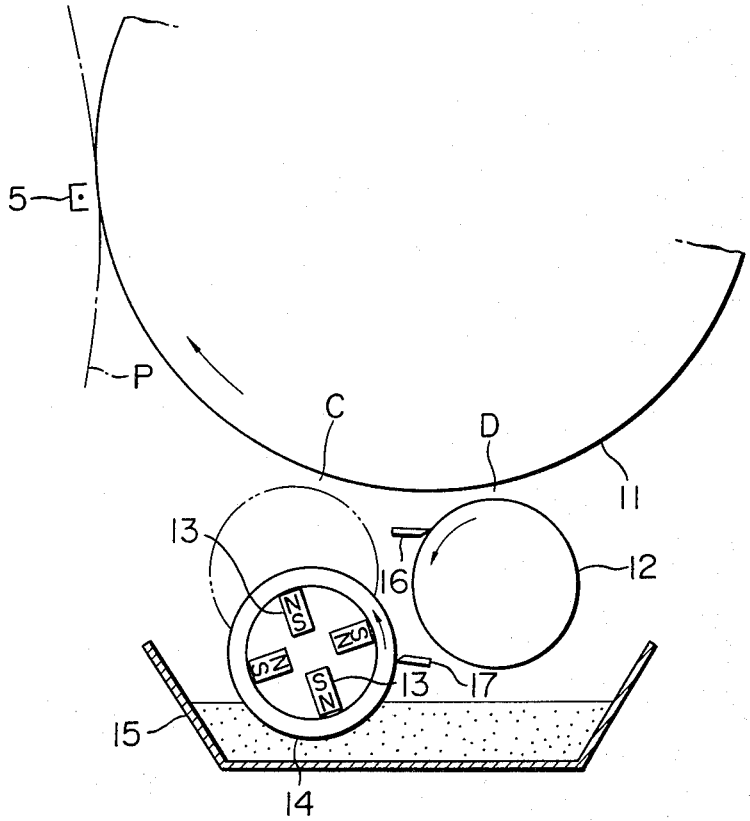
FIG. 2 is a schematic illustrative view of one of the embodiments of a developing device of the present invention.

Below is a description of a developing device using magnetic toner. In FIG. 2, a reference numeral 11 is a rotary drum type charge retaining member comprising, for example, a photoconductive material. There is provided a first sleeve 12 having a toner transporting function that is, for example, to absorptively carry the toner by voltage application so as to face opposite to the outer circumferential surface of the rotary drum 11 in development area D and to revolve in the direction of the arrow. Further, there is provided a second sleeve 14 which revolves around magnets 13 fixedly arranged for transporting the toner. During the first revolution of said drum 11, i.e., while an electrostatic latent image on said drum 11 is passing through development area D, said second sleeve 14 is set to its first position so as to be in the first operational state (where the said second sleeve is shown by the solid lines) so as to supply the toner to the first sleeve 12. During the second revolution of said drum 11, the second sleeve is in a second position shown by a chain line. In this second position, the surface of said drum 11 from which a transfer paper transferred thereto with a toner image has been separated is passing through a cleaning area C (i.e., a space formed between the second sleeve 14 and the drum 11). During this second revolution of drum 11, the second sleeve 14 is set to its said second position so as to be in the second operational state so as to remove the toner remaining on said drum 11. To be more concrete, in this example, the above second sleeve 14 is supported, in a toner chamber 15, by a supporting mechanism (not shown in the drawing) so as to be freely movable between the first position facing closely opposite the first sleeve 12 but separated far from the drum 11 and the second position close to said drum 11. When the second sleeve 14 is at the first position, a D.C. voltage of a suitable polarity or an alternating voltage superposed with a voltage such as a sine-wave alternating current voltage or a pulse of various duty ratios, is applied thereto. Out of the toner transported by the function of the second sleeve 14, only the toner which is charged at the polarity required mainly for development is supplied onto the first sleeve 12, and at the same time the magnetic force of magnets 13 which are arranged inside said second sleeve 14 functions to remove the remaining toner on the drum 11 when the second sleeve 14 is at the second position.

Numerals 16 and 17 in the drawing are respectively a developer scraping member for scraping off a toner layer on the outer circumferential surface of the first sleeve 12 and a developer layer thickness regulating member for regulating the thickness of a developer layer on the outer circumferential surface of the second sleeve 14.

In the example illustrated in FIG. 2, while the rotary drum type charge retaining member 11 is running in the first revolution of the cycle and the second sleeve 14 is set in the first operational state and is rotated in the direction of the arrow, the toner inside the toner chamber 15 is absorbed on the outer circumferential surface of said second sleeve 14 and then is transported to the position opposite to the first sleeve 12 after passing the toner layer thickness regulating member 17. At that position the toner having a certain charge polarity and charge volume is absorbed onto the outer circumferential surface of the first sleeve 12 by the voltage applied between sleeves 12 and 14 by a power source (which is not shown in the drawing), and thereafter such specific toner is transported in development area D by the revolution of the first sleeve 12 in the direction of the arrow. The toner transported to sleeve 12 is attracted onto the drum 11 by means of the voltage (i.e., the so-called bias voltage) applied between the first sleeve 12 and the drum 11, and a toner image thus formed is transferred onto the transfer paper which is conveyed to transfer paper passage P by means of a transfer electrode 5 that is arranged on the downstream side of development area D. Thereafter, the drum 11 is exposed wholly to light or the electrostatic charge thereof is eliminated by means of the charge eliminating electrode. Then the drum 11 begins its second revolution fo the cycle and again it is revolved to the position where the developing device is located, and thus a cleaning operation is carried out as described after. In other words, while the drum 11 is in its second revolution of the cycle, the toner remaining on the surface of the drum 11 being passed through cleaning area C is attracted by the magnetic force of magnets 13 fixed inside the second sleeve 14 so as to be absorbed onto the outer circumferential surface of the second sleeve 14 by setting the second sleeve 14 in the second operational state (second position thereof), and thus the cleaning process for the drum 11 can be accomplished.

In the example illustrated in FIG. 2, the structure thereof is designed so as to make the second sleeve 14 switchable between the first operational state (i.e., the state where the sleeve 14 is positioned at the first position close to the first sleeve 12) and the second operational state (i.e., the state where the sleeve 14 is positioned at the second position close to the drum 11) to perform the transport and supply of the toner for development and also the cleaning for the drum 11. Thus, the second sleeve 14 serves as the common member for the above purpose. As the result, it is possible to meet the demand for the simplification of the device and for the reduction of the cost thereof. Also, the second sleeve 14 abosrbing and transporting the toner from the toner chamber 15 is ordinarily given a great transporting and carrying force and such force is utilized, as it is, for cleaning the drum 11, so that it is possible to perform an excellent cleaning operation. Still further, it is possible to make the state most constantly suitable for the developing operation because any change or condition is not imposed at all on the first sleeve 12, so that no bad influence is exerted on the development of an electrostatic image. Thus, it is possible to attain excellent development and cleaning without fail.

In the invention, after the second sleeve 14 is set at the second position, it is also possible, for example, to arrange a scraping blade (not shown in the drawing) on the downstream side of the cleaning area C on the outer circumferential surface of the second sleeve 14. If so arranged, the toner absorbed on the outer circumferential surface of the second sleeve 14 is scraped off by said scraping blade and is then restored into the toner chamber 15.

Figure 3:
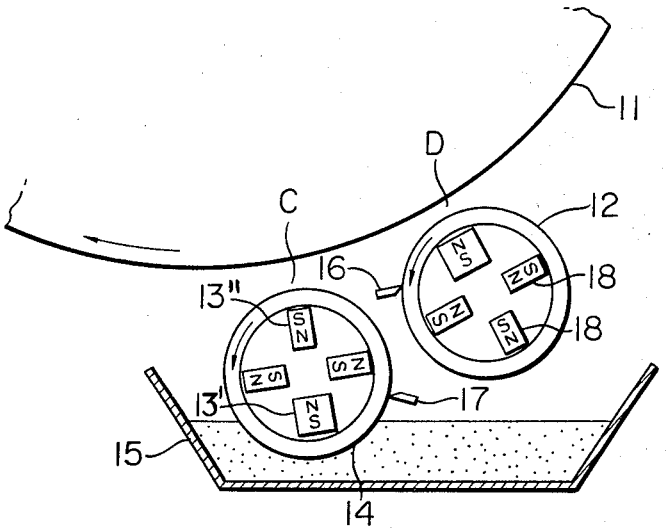
FIGS. 3 and 4 are respective illustrative views of other embodiments of a developing device of the present invention.
Figure 4:
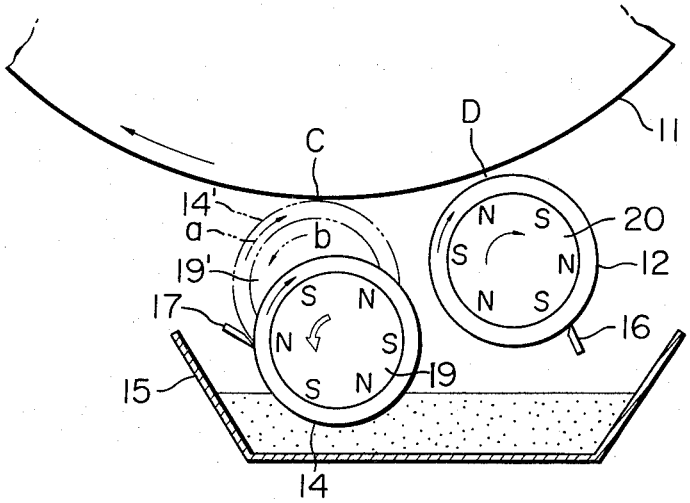

In the present invention, for the purpose of transporting toner which originally comes from the toner chamber 15 but then absorbs and holds on the outer circumferential surface of the second sleeve 14, it is also possible to revolve the magnets while the second sleeve is not revolved, in place of the construction wherein the second sleeve 14 is revolved around magnets 13 which are not revolved; or to provide a construction such that, as shown in the example of FIG. 4, a magnet 19 and the second sleeve 14 are both revolved; or to provide a construction wherein the surface of the sleeve 14 is simply roughed up to be capable of transporting toner by the frictional force of said rough surface. Further, for the purpose of absorbing the toner which came from the second sleeve 14 onto the outer circumferential surface of the first sleeve 12 and then transporting them to development area D, it is also possible to utilize the magnetic force of magnets in place of the utilization of the method to apply a voltage. For example, as shown in FIG. 3, the first sleeve 12 is made revolvable around magnets 18 which are fixedly provided. It is possible to make the fixed magnets magnetically heteropolar to each other at the position where both the first and second sleeves face each other. As shown in FIG. 4, both magnet 20 and the first sleeve 12 are revolved. It is also possible to make magnet 19 of the second sleeve 14 and magnet 20 of the first sleeve 12 revolve respectively in the opposite directions to each other and also to make magnetically heteropolar constantly the magnets face to face with each other among those of magnets 19 and 20.

The present invention, as in the example shown in FIG. 2, is not limited to that where the second sleeve 14 is movable at the time when said sleeve 14 becomes in the second state, from the first position where the sleeve 14 is positioned in the first operational state, but it is also within the scope of the invention to strengthen the magnetic force to be applied from the second sleeve 14 to the drum 11 as the sleeve 14 is at the position in the first operational state. FIG. 3 shows such an example, wherein a magnet 13' having the magnetic force to give a strong toner holding capability is arranged inside the second sleeve 14 to constitute a magnet holding mechanism so that said magnet 13' can be positioned away from said drum 11 as shown in FIG. 3 when said second sleeve 14 is in its first operational state, while said magnet 13' is positioned at the position close to said drum 11 (in the drawing, it is corresponding to the position of the magnet 13'') after revolving for 180-degrees when said second sleeve 14 is in the second operational state. For reference, the numeral 13'' indicated in FIG. 3 is a magnet having a relatively smaller magnetic force incapable of attracting the toner on the surface of said drum 11.

Accordingly, in the example of FIG. 3, when the drum 11 is in the first revolution, the toner in the toner chamber 15 is absorbed onto the outer circumferential surface of the second sleeve 14 by the attraction of said magnet 13' to be transported to the first sleeve 12. When the said drum 11 is in the second revolution, that is to say, when the surface of said drum 11 passes through cleaning area C formed between said surface thereof and said second sleeve 14 after completion of toner image transfer onto the transfer paper, magnet 13' revolves over 180-degrees and the toner remaining on the surface of said drum 11 is attracted onto the surface of the second sleeve 14 by the attraction of the magnetic force of said magnet 13', and thus, the cleaning of said drum 11 can be accomplished.

In such an example in which magnets are arranged freely movable inside the second sleeve 14 as mentioned above, it may be good to arrange magnets to be applied into the cleaning process away from the surface of the drum 11 so as not to attract the toner on the drum 11 while the drum 11 is in the first rotation of a cycle, and they may be arranged closely to the surface of said drum 11 so as to attract the toner remaining on the surface of the drum 11 when the drum 11 is in the second rotation of cycle. Accordingly, it is also possible to change the strength of the magnetic field in a cleaning area by making magnet 13'' reciprocate in the radial direction (as shown in FIG. 3) inside the second sleeve 14.

In the present invention, it is also possible that, when the second sleeve 14 is movable between the first and the second positions as described above, said second position is set at the position so that the toner having been absorbed on the surface of the second sleeve 14' can be brought into contact with the drum 11 (which is indicated by a chain line in FIG. 4). Further, at the said second position, both of the second sleeve 14' and magnet 19' are made to revolve respectively. For example, the second sleeve 14' is rotatable in the direction of arrow a and magnet 19' is rotatable in the direction of arrow b. If constructed as above, a cleaning process can be attained because, while the drum 11 is in the second rotation of a cycle, the toner which is absorbed on the surface of second sleeve 14 performs a brushing function to scrape and peel the remaining toner off from the surface of the drum 11, and thus the cleaning process can be completed. It is a matter of course that magnet 19 is reversely revolved at the same revolution speed as that of magnet 20 of the first sleeve 12 in the same direction of the arrow b, as shown in the drawing, (i.e., in the counterclockwise direction in the drawing) while the second sleeve 14 is at the position in the first operational state. It may also be allowed to make switchable the revolution of magnet 19 inside the second sleeve 14 clockwise or counterclockwise in accordance with the first or the second operational state.

Also, in the invention, when the second sleeve 14 is set in the second operational state, it is possible to increase the cleaning performance with the increase of the revolution speed of the magnet and/or sleeves or applying a voltage between the drum 11 and said magnet or said sleeve so that said remaining toner may be attracted. In this instance, it may also be allowed to let the second sleeve 14 be close to the drum 11 when it is in the second operational state, or to let it stand still at the position in the first operational state. In the case of developing nonmagnetic toner, it is effective to carry out the cleaning process with such applied voltage.

Further, in the present invention, when a cleaning process is being carried out by the second sleeve 14, it is essential that the toner on the surface of said second sleeve 14 cannot be supplied to the drum 11 via first sleeve 12, and for that purpose, it is effective that, for example, a specific voltage is applied to the space between the first sleeve 12 and the drum 11; that the voltage applied to the space between the first sleeve 12 and the second sleeve 14 is neutralized; and that the first sleeve 12 is separated from the drum 11.

Still further, in the present invention, it is also possible to utilize a charge retaining member formed platewise which reciprocates in motion between the development area and the transfer area, in place of a revolving drum.

In the above drawings and the descriptions, there are exemplified the examples in which the first sleeve is arranged to the upstream side of the second sleeve (i.e., the right-hand side of the drawings) to the movement of a charge retaining member, and the present invention should, however, not be limited thereto, as a matter of course. Similarly, the arrangements of the toner layer thickness regulating member 17 and the toner layer scraping member 16 may be suitably located at other positions than those in the above examples. Further, the "sleeve" shall not always be limited to a hollow cylinder, but may be a solid cylinder in some instances, provided that it is capable of transporting toner.

As described above, the present invention is directed to a developing device comprising first and second sleeves, which are effective for controlling charging of toner when a one-component developer is used, so as to make the second sleeve switchable from a first operational state for supplying toner to the primary sleeve to a second operational state for removing the remaining toner on the surface of the charge retaining member and vice versa. Therefore, there is successfully attained not only transporting and supplying of toner to be applied to the development, but also the cleaning of the surface of the charge retaining member by using the second sleeve to serve as a common member for these purposes. Consequently it is possible to realize the simplification of the structure and the reduction of the cost of the device, and at the same time an excellent development and cleaning can be achieved, because there is nothing at all to apply any change or condition to the first sleeve that is to transfer toner directly to said charge retaining member, so that the first sleeve can be constantly in the most suitable condition for development.

What is claimed is:

1. In a two-cycle electrophotographic copying apparatus comprising:

a rotatable charge retaining member;

a charging device, an exposure mechanism, a developing device and a transferring device respectively sequentially arranged about said charge retaining member in the direction of its rotation for operation during a first operation of said charge retaining member to form a toner image of an original, and for cleaning of remaining toner from said charge retaining member during a second operation of said charge retaining member to prepare said charge retaining member for a next succeeding copying operation;

the improvement wherein:

said developing device comprises a first sleeve arranged adjacent said charge retaining member for developing an electrostatic latent image on the surface of said charge retaining member by means of a developer during said first operation of said charge retaining member; and a second sleeve arranged adjacent said first sleeve, said developing device and said charge retaining member, said second sleeve supplying said developer from said developing device to said first sleeve during said first operation of said charge retaining member and said second sleeve cleaning remaining toner from the surface of said charge retaining member during said second operation of said charge retaining member.

2. The copying apparatus of claim 1, wherein said second sleeve is movable between a first position and a second position, said second position being close to said charge retaining member and said first position being relatively far from said charge retaining member, said second sleeve being in a first operational state at said first position during said first operation of said charge retaining member and being in a second operational state at said second position during said second operation of said charge retaining member.

3. The copying apparatus of claim 2, wherein said second sleeve has a magnet arranged therein; said magnet being movable to a position close to said charge retaining member when said second sleeve is in said second operational state thereof.

4. The copying apparatus of claim 1 or 3, wherein said first sleeve has a magnet arranged therein.

5. The copying apparatus of claim 3, wherein said first sleeve has a magnet arranged therein; and said magnet of said first sleeve and said magnet of said second sleeve are arranged such that magnetic sections thereof which are face to face with each other are magnetically heteropolar.

6. The copying apparatus of claim 5, wherein both said magnet of said first sleeve and said magnet of said second sleeve are rotatable respectively in opposite directions.

7. The copying apparatus of claim 6, wherein said sleeves are rotatable in the same direction.

8. The copying apparatus of claim 1, comprising means for supplying a voltage across the space between said first sleeve and said charge retaining member.

9. The copying apparatus of claim 1, wherein said charge retaining member is a revolving drum.

10. The copying apparatus of claim 1, wherein said developing device further comprises a developer scraping member for scraping off the residual toner on the surface of said first sleeve after the development.

11. The copying apparatus of claim 1, wherein said developing device further comprises a developer layer regulating member for regulating the thickness of the developer layer on the surface of said second sleeve for supplying said developer to said first sleeve.

12. The copying apparatus of claim 1, wherein said first operation of said charge retaining member is a first rotation cycle thereof, and said second operation of said charge retaining member is a second rotation cycle thereof in the same rotational direction as said first rotation cycle.

13. The copying apparatus of any one of claims 1, 2 or 3, wherein said first and second sleeves are both rotatable drum-like members.

14. The copying apparatus of claim 13, wherein said sleeves are rotatable in the same direction.

15. The copying apparatus of claim 1, wherein at least one of said sleeves has a magnet means arranged therein, said magnet means having a section of higher magnetic force than the remaining sections thereof said higher magnetic force magnet section being on a first location during said first operation of said charge retaining member, and being in a second location during said second operation of said charge retaining member.

16. The copying apparatus of claim 1 or 15, wherein said sleeves are fixed relative to said charge retaining member, but are rotatable so as to move said higher magnetic force magnet section between said first and second location thereof by rotation of the respective sleeve.

17. A method of two-cycle electrophotographic copying using a copying apparatus comprising:

a rotatable charge retaining member;

a charging device, an exposure mechanism, a developing device and a transferring device respectively sequentially arranged about said charge retaining member in the direction of its rotation for operation during a first operation of said charge retaining member to form a toner image of an original, and for cleaning of remaining toner from said charge retaining member during a second operation of said charge retaining member to prepare said charge retaining member for a next succeeding copying operation;

the method comprising:

providing said developing device with a first sleeve and arranging said first sleeve adjacent said charge retaining member for developing an electrostatic latent image on the surface of said charge retaining member by means of a developer during said first operation of said charge retaining member; and arranging a second sleeve adjacent said first sleeve, said developing device and said charge retaining member for supplying, via said second sleeve, said developer from said developing device to said first sleeve during said first operation of said charge retaining member and said second sleeve cleaning remaining toner from the surface of said charge retaining member during said operation of said charge retaining member.

18. The copying apparatus of claim 1, wherein said sleeves are fixed relative to said charge retaining member, but are rotatable, and wherein at least said second sleeve has a magnet means arranged therein, said magnet means of said second sleeve having a section of higher magnetic force than the remaining sections thereof, said second sleeve having a rotatable portion to rotate said magnet means such that said higher magnetic force magnet section is in a position farthest from said charge retaining member during said first operation of said charge retaining member, and being in a second position closest to said charge retaining member during said second operation of said charge retaining member.

19. The copying method of claim 18 wherein at least one of said sleeves has a magnet means arranged therein, said magnet means having a section of higher magnetic force than the remaining sections thereof, said higher magnetic force magnet section being in a first location during said first operation of said charge retaining member, and being in a second location during said second operation of said charge retaining member.

20. The copying method of claim 19, wherein at least said second sleeve has said magnet means arranged therein, and said second sleeve has a rotatable portion which is rotatable to move said higher magnetic force magnet section to a position farthest from said charge retaining member during said first operation of said charge retaining member, and to a position closest to said charge retaining member during said second operation of said charge retaining member.

21. The copying method of claim 17, comprising moving said second sleeve between a first position and a second position, said second position being close to said charge retaining member and said first position being relatively far from said charge retaining member, said second sleeve being in a first operational state at said first position during said first operation of said charge retaining member and being in a second operational state at said second position during said second operation of said charge retaining member.

22. The copying method of claim 21, comprising providing said second sleeve with a magnet arranged therein; and moving said magnet to a position close to said charge retaining member when said second sleeve is in said second operational state thereof.

23. The copying method of claim 17 or 22, comprising providing said first sleeve with a magnet arranged therein.

24. The copying method of claim 22, comprising providing said first sleeve with a magnet arranged therein; and arranging said magnet of said first sleeve and said magnet of said second sleeve such that magnetic sections thereof are face to face with each other and are magnetically heteropolar.

25. The copying method of claim 24, comprising rotating said magnet of said first sleeve and said magnet of said second sleeve respectively in opposite directions.

26. The copying method of claim 25, comprising rotating said sleeves in the same direction.

27. The copying method of claim 17, wherein said first operation of said charge retaining member is a first rotation cycle thereof, and said second operation of said charge retaining member is a second rotation cycle thereof in the same rotational direction as said first rotation cycle.

28. The copying method of claim 17, wherein said sleeves are fixed relative to said charge retaining member, but are rotatable.

* * * * *